US006336852B1

(12) United States Patent
Roos

(10) Patent No.: US 6,336,852 B1
(45) Date of Patent: Jan. 8, 2002

(54) ROLL WITH SURFACE COATING

(75) Inventor: Anders Roos, Fjugesta (SE)

(73) Assignee: Orebro Golvindustri AB, Stockholm (SE)

( * ) Notice: Subject to any disclaimer, the term of this patent is extended or adjusted under 35 U.S.C. 154(b) by 0 days.

(21) Appl. No.: 09/403,040

(22) PCT Filed: Dec. 13, 1999

(86) PCT No.: PCT/SE98/00707

§ 371 Date: Oct. 25, 1999

§ 102(e) Date: Oct. 25, 1999

(87) PCT Pub. No.: WO98/48977

PCT Pub. Date: Nov. 5, 1998

(30) Foreign Application Priority Data

Apr. 25, 1997 (SE) ..... 9701554

(51) Int. Cl.[7] ..... B24B 23/00
(52) U.S. Cl. ..... 451/352; 451/350; 428/56
(58) Field of Search ..... 428/36.9, 56; 451/350, 451/352

(56) References Cited

U.S. PATENT DOCUMENTS

| | | | | |
|---|---|---|---|---|
| 2,410,536 A | | 11/1946 | Vonnegut | |
| 2,415,308 A | | 2/1947 | Schulte | |
| 5,575,710 A | * | 11/1996 | Kramer | 451/350 |

FOREIGN PATENT DOCUMENTS

| | | |
|---|---|---|
| GB | 333658 | 8/1930 |
| GB | 1276204 | 6/1972 |

* cited by examiner

*Primary Examiner*—Alexander S. Thomas
(74) *Attorney, Agent, or Firm*—Dennison, Scheiner & Schultz

(57) ABSTRACT

A floor sander is disclosed that includes a drum having an outer surface formed from a number of units shaped like the frustrum of a sector, each having a first end receivable in a groove on the outer surface of an inner drum member so that, if the surface of the drum is damaged, one or more units can be replaced individually instead of replacing the entire drum or outer drum surface.

3 Claims, 1 Drawing Sheet

ROLL WITH SURFACE COATING

BACKGROUND OF THE INVENTION

The present invention relates to a roll with rubber coating intended for use in grinding machines, for floors for instance, where the roll cooperates with an abrasive sleeve or an endless abrasive belt. When using such machines there is of course considerable wear and in many cases it is sufficient to replace only the abrasive belt. Sometimes, however, the wear may be more extensive and the rubber coating also becomes worn. In this case the roll must be removed and provided with a new rubber coating, which entails an expensive and laborious procedure to restore the roll to its original condition.

SUMMARY OF THE INVENTION

The object of the present invention is to avoid the complicated repair procedure mentioned above. According to the invention this is achieved by the coating being divided into individual units of equal size, which have a cross section in the form of a sector. Said divided coating is intended for placing on a cylinder surface provided with a number of slots corresponding to the number of units, each unit being so shaped at its lower end that it can be inserted into cooperating slots and retained there. The individual units can be glued firmly to the surface of the roll, in the slots, or be secured by means of a screw joint. Each unit is of suitable material, e.g. rubber, and each unit may have such consistency that upon rotation of the roll the unit is deformed by centrifugal force so that the roll and its coating is able to influence a cooperating abrasive sleeve or belt in radial direction. Each unit with sector-like cross section is suitably stiffened at its lower end in some way, e.g. by means of a metal strip.

Each unit with sector-shaped cross section is provided with longitudinal recessed grooves along each of its side surfaces and into these grooves strip-like elements protrude from the slot into which the unit is inserted. Due to the design with grooves in the side surfaces and the outwardly directed strip-like protrusions, each unit must be inserted into the roll from the side.

BRIEF DESCRIPTION OF THE DRAWINGS

The present invention will be described in more detail with reference to the accompanying drawings in which.

DETAILED DESCRIPTION OF THE INVENTION

Figure 1:
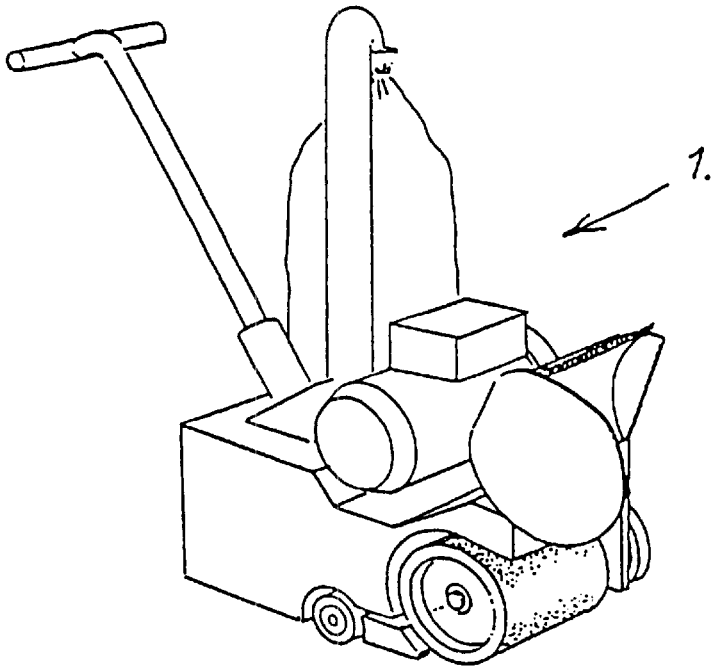
FIG. 1 shows a floor sander and FIG. 2 shows a roll with surface coating units having sector-shaped cross section and a sleeve-shaped abrasive sleeve.
Figure 2:
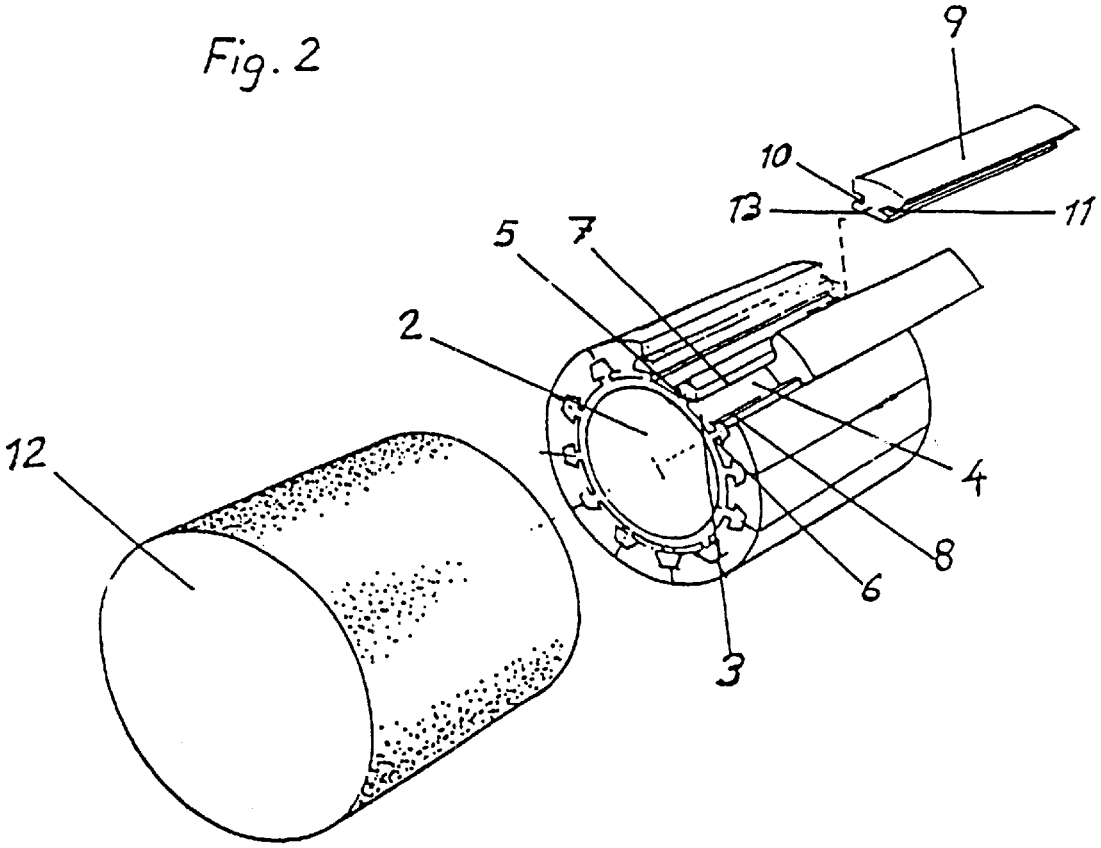

The drawings show a machine 1 provided at the front with a roll having an abrasive sleeve. Drive means and arrangements for collecting up products from the grinding are incorporated in the machine in the normal way. FIG. 2 shows a roll 2 which is cylindrical and provided with a number of slots 3, each slot having a bottom 4 and two side walls 5 and 6, the upper ends of the walls being provided with outwardly directed flanges or strips. The inwardly directed strips in the slot 3 have been designated 7 and 8. A unit 9 can be inserted into each slot, said unit having two grooves 10 and 11 designed to cooperate with the inwardly directed strips 7 and 8. When all units 9 with sector cross section have been inserted into the roll 2 they together form a circular outer surface, and each unit can be secured in a slot by means of gluing or with the aid of a screw joint. The units may be made of any suitable type of material. A suitable material is rubber and it should have such consistency that it is deformed upon rotation of the roll so that a radial, outwardly directed force is established. Each unit 9 is preferably reinforced along its lower end by means of a metal strip. When all the sector-like units are in position on the roll, the grinding material sleeve 12 is applied, after which the roll and abrasive sleeve can be placed in the machine. During use of the machine the individual sector-like units will efficiently retain the abrasive sleeve 12 since each unit influences the abrasive sleeve through centrifugal force.

Wear naturally occurs during use of the grinding machine and it is of course possible that wear may arise on the coating surface of the roll. The great advantage of the present invention is that the sector-like units can be replaced at those points where wear has occurred. No complicated surface coating of the roll is thus necessary. In the event of the wear being so drastic that the entire coating surface is ruined, it is an extremely simple matter to replace all the units.

It should be obvious that a roll of the present type can be used either as a driven or a driving roll and the rolls can be used together with an endless belt, as well as in other functions where it is desirable to have a roll with a coating which is easy to replace.

What is claimed is:

1. A floor sander (1) with wheels for hand operated displacement along a surface to be treated, said sander (1) comprising a motor-driven cylindrical body having an outer surface comprising a casing (12) with a grinding agent on its outside surface;

characterized in that the cylindrical body comprises a first cylindrical tube (2) and a second cylindrical tube of elastic material around the outer surface of the first cylindrical tube, said second tube having an inner surface in contact with the outer surface of the first tube (2), said second tube comprising a number of units (9) which are equal long, homogeneous and having a cross section like a frustrum of a sector, said first tube including a number of radial flanges extending along the whole first tube, each said flange being arranged between two adjacent surfaces of two said units (9) each radial flange including at an upper end two transversal bulges which are directed in two different directions and extending along the length of the flange, each unit (9) having a longitudinal and inwardly directed groove at each side surface such that the units create a cylindrical body during influence of a centrifugal force.

2. A floor sander, comprising:

a rotatable cylindrical body having an outer surface;

a plurality of flanges disposed on said outer surface in a lengthwise direction, each flange including a pair of extending bulges opposing one another;

a plurality of homogenous and frustrum-shaped units, each of said units having a pair of opposing grooves configured and dimensioned to engage a corresponding said bulge on said outer surface to removably and slidably mount said unit on said cylindrical body; and a sand belt removably mounted around the circumference of said cylindrical body and over said plurality of units.

3. A floor sander comprising wheels for rollingly supporting said sander on a surface to be treated and a rotating drum having an abrasive material attached to an outer surface of said drum, said drum comprising:

an inner cylinder having an outer surface including a plurality of radially extending grooves each having a width and an opening into each of said grooves having a width less than the width of each groove; and, and an outer cylinder comprising a plurality of homogeneous units having a first end with a portion shaped to fit into and be retained by one of said plurality of grooves and a second curved end, whereby said second curved ends of said units form a cylindrical outer surface of said drum, said cylindrical outer surface having a first diameter when said drum is at rest and a second diameter when said drum rotates.

* * * * *